US009492862B2

(12) United States Patent
King

(10) Patent No.: US 9,492,862 B2
(45) Date of Patent: Nov. 15, 2016

(54) FASTENER INSTALLATION TOOL

(71) Applicant: AVDEL UK LIMITED, Hertfordshire (GB)

(72) Inventor: Richard King, Hertfordshire (GB)

(73) Assignee: Avdel UK Limited, Hertfordshire (GB)

( * ) Notice: Subject to any disclaimer, the term of this patent is extended or adjusted under 35 U.S.C. 154(b) by 0 days.

(21) Appl. No.: 14/883,924

(22) Filed: Oct. 15, 2015

(65) Prior Publication Data

US 2016/0107224 A1 Apr. 21, 2016

(30) Foreign Application Priority Data

Oct. 20, 2014 (GB) ..... 1418611.8

(51) Int. Cl.

| | |
|---|---|
| ***B21J 15/20*** | (2006.01) |
| ***B21J 15/18*** | (2006.01) |
| ***B21J 15/30*** | (2006.01) |
| ***B21J 15/04*** | (2006.01) |
| ***B21J 15/22*** | (2006.01) |
| ***B21J 15/10*** | (2006.01) |
| ***B21J 15/32*** | (2006.01) |

(52) U.S. Cl.

CPC ..... *B21J 15/18* (2013.01); *B21J 15/043* (2013.01); *B21J 15/105* (2013.01); *B21J 15/22* (2013.01); *B21J 15/30* (2013.01); *B21J 15/326* (2013.01)

(58) Field of Classification Search

CPC ..... B21J 15/20; B21J 15/30; B21J 15/18; B21J 15/105; B21J 15/326

See application file for complete search history.

(56) References Cited

U.S. PATENT DOCUMENTS

| | | | | |
|---|---|---|---|---|
| 3,402,778 | A | 9/1968 | Carter | |
| 4,005,598 | A | 2/1977 | Ehmann | |
| 4,517,820 | A | 5/1985 | Oefinger | |
| 4,587,829 | A | 5/1986 | Sukharevsky | |
| 5,579,641 | A | 12/1996 | Wilcox | |
| 6,892,431 | B2 * | 5/2005 | Campbell | B25B 27/0014 29/243.526 |
| 6,907,648 | B2 * | 6/2005 | Eldessouky | B21J 15/105 29/243.523 |
| 2011/0048099 | A1 | 3/2011 | Cobzaru | |
| 2013/0117981 | A1 | 5/2013 | Seewraj | |

FOREIGN PATENT DOCUMENTS

| | | |
|---|---|---|
| AU | 2007203361 | 8/2007 |

* cited by examiner

*Primary Examiner* — David B Jones
(74) *Attorney, Agent, or Firm* — Kofi A. Schulterbrandt; Michael P. Leary

(57) ABSTRACT

A fastener installation tool for installing a fastener by gripping and drawing back a stem of the fastener comprises a hydraulic cylinder, and a hydraulic piston assembly located in the hydraulic cylinder for use in drawing back the stem of a fastener. The hydraulic piston assembly comprises an elongate draw part and a separate hollow piston part mounted on the elongate draw part such that the elongate draw part extends at least partly through the hollow piston part. The elongate draw part and the hollow piston part are formed from different materials.

17 Claims, 5 Drawing Sheets

FASTENER INSTALLATION TOOL

CROSS-REFERENCE TO RELATED APPLICATIONS

This application claims priority from UK Patent Application No. GB1418611.8, filed Oct. 20, 2014, the disclosure of which is incorporated herein by reference in its entirety.

FIELD OF THE INVENTION

The present invention relates to fastener installation tools for installing (i.e. installing, setting or placing) fasteners. In particular, the invention relates to installation tools for installing rivets, especially blind rivets, which are installed by drawing back (pulling) the stem of the rivet and then breaking off the stem.

Pneumatically powered fastener installation tools which utilize a hydraulic piston and cylinder arrangement to draw back the stem of the fastener and break off the stem have been known and used for many years. For example, each of the patent publications U.S. Pat. No. 4,517,820, GB 2116102 A and EP 0828575 B1 discloses such a tool. In each case, a front end of a drawbar/piston rod is arranged to be attached to a fastener gripping assembly, and a hydraulic piston is secured to the drawbar/piston rod. Drawing back the fastener stem and breaking it off involve high forces and pressures, which is why a hydraulic system is used. For example, the peak pressure produced in the hydraulic cylinder is typically in the region of 40 MPa. The high forces and pressures, and the high mechanical shock associated with breaking off a fastener stem, also necessitate the fastener gripping and piston assemblies being formed from a high strength and high toughness material, namely high strength steel.

BACKGROUND OF THE INVENTION

A first aspect of the present invention provides a fastener installation tool for installing a fastener by gripping and drawing back a stem of the fastener, comprising a hydraulic cylinder, and a hydraulic piston assembly located in the hydraulic cylinder for use in drawing back the stem of a fastener, the hydraulic piston assembly characterised by comprising an elongate draw part of first tensile strength and a separate hollow piston part of second tensile strength, which hollow piston part is mounted on the elongate draw part such that the elongate draw part extends at least partly therethrough, wherein the elongate draw part and the hollow piston part are formed from different materials and wherein the first tensile strength is lower than the second tensile strength.

Preferably the hollow piston part provides at least part of a hydraulic fluid contacting piston surface of the hydraulic piston assembly, more preferably the hollow piston part provides substantially the entire hydraulic fluid contacting piston surface of the hydraulic piston assembly.

With the present invention, it has surprisingly been found that it is not necessary to form the hollow piston part and the elongate draw part of a fastener installation tool from the same high strength and high toughness material, and it has also been found that there are unexpected advantages associated with forming the hollow piston part and the elongate draw part from different materials, as explained below.

BRIEF SUMMARY OF THE INVENTION

In preferred embodiments of the invention, the material of the hollow piston part has a lower density and/or a lower toughness than does the material of the elongate draw part. For example, in at least some embodiments of the invention, the material of the hollow piston part may have a density in the range 2.65 to 2.95 g/cm3, e.g. 2.8 g/cm3, and/or may have a tensile yield strength of at least 400 MPa, preferably at least 450 MPa, and preferably no greater than 600 MPa, more preferably no greater than 550 MPa, e.g. approximately 500 MPa. In at least some embodiments of the invention, for example, the material of the elongate draw part may have a density in the range 7.75 to 8.05 g/cm3, and/or may have a tensile yield strength of at least 1400 MPa, preferably at least 1500 MPa, and preferably no greater than 2200 MPa, more preferably no greater than 2000 MPa. Advantageously, the hollow piston part may be formed from a low density metal material, for example aluminium or an aluminium alloy. The elongate draw part preferably is formed from steel, more preferably a high strength steel.

Hitherto, it was understood in the art of fastener installation tools that the hydraulic piston assembly needed to be formed from a high strength and high toughness material, i.e. high strength steel, for the reasons already referred to, namely the high pressures, forces and shocks which the piston assembly is subjected to during use. In particular, in addition to the high pressures associated with the hydraulic system of the tool, the breaking off of the stem of a rivet (or other fastener) results in large mechanical shocks being transmitted to the hydraulic piston assembly as a result of high instantaneous bending moments which are generated when the stem breaks free. Such high bending moments affect not only the elongate draw part of the piston assembly, but also the hollow piston part which is mounted on the elongate draw part. It was previously understood in the art that in order to ensure that the hydraulic system of a fastener installation tool had adequate durability, the entire hydraulic piston assembly therefore needed to be formed from the same high strength and toughness material. However, with the present invention it has now been found that the hollow piston part of the hydraulic piston assembly may be formed from a material which is less tough and/or strong, and optionally significantly less tough and/or strong, than the material from which the elongate draw part is formed. For example, it has surprisingly been found that the hollow piston part may be formed from a low density metal material, such as aluminium or an aluminium alloy, while the elongate draw part is formed from a high strength steel. The elongate draw part advantageously is formed from a high strength and high toughness material in order to withstand not only the high tensile stresses associated with drawing back the stem of a fastener, but also the large mechanical shocks associated with the stem breaking off. However, the hollow piston part advantageously may be formed from a low density material having relatively low strength and toughness despite the need to withstand the high pressures of the hydraulic system and the large mechanical shocks to which the hydraulic piston assembly is subjected.

The ability to form the elongate draw part and the hollow piston part of the hydraulic piston assembly from different materials provides the unexpected advantage (contrary to the prior understanding in the art) that each part may be optimized separately, resulting in significant benefits both for the manufacturer and for the end user. For example, with the present invention, it is now possible to minimize the amount of high density, high strength, high toughness material which is used, and thus also to minimize the amount of machining of such a material (and the time, effort and cost involved), to only a part of the hydraulic piston assembly, namely the elongate draw part. Additionally, the weight, cost, and machining difficulty associated with the hollow piston part of the hydraulic piston assembly may be minimized. Furthermore, the user of the fastener installation tool may be provided with a lighter weight tool, which may also be more durable because the materials and the functional characteristics of each of the elongate draw part and the hollow piston part may be optimized separately. A lighter weight tool may make the tool easier to use (especially when the tool is a hand-held tool), and may provide greater durability (especially when the tool is robotically used or part of an automated installation apparatus), for example.

Preferably, the elongate draw part of the hydraulic piston assembly includes a stop portion against which a stop region of the hollow piston part abuts. The stop portion of the elongate draw part preferably comprises a laterally outwards projecting portion. In use, any hydraulic fluid in the hydraulic cylinder preferably is situated on an opposite side of the hollow piston part to the stop portion of the elongate draw part. Advantageously, at least part of the hollow piston part may extend around at least part of the stop portion of the elongate draw part.

The hollow piston part of the hydraulic piston assembly preferably is fixed in place on the elongate draw part. For example, the hollow piston part may be press-fitted on the elongate draw part. However, substantially any type of fixing may be used, for example a screw threaded attachment.

The elongate draw part and the hollow piston part of the hydraulic piston assembly preferably are sealed together to prevent hydraulic fluid from flowing between them. At least one seal, e.g. an O-ring seal, may be located between the elongate draw part and the hollow piston part, for example. The seal may be formed from a polymeric material, e.g. a polyurethane.

A front region of the elongate draw part preferably is arranged to have a fastener stem gripping assembly attached directly or indirectly thereto. The elongate draw part preferably extends entirely through the hollow piston part.

In preferred embodiments of the invention, the elongate draw part is hollow along its length, to permit, in use, a broken-off stem of a fastener to travel therethrough from a front end to a rear end of the elongate draw part and to be expelled therefrom, e.g. into a fastener stem collection container attached to the fastener installation tool. A rear region of the elongate draw part preferably includes a hollow guidance portion which is attached to, or formed in one piece with, the remainder of the elongate draw part, for at least assisting in the guidance, in use, of a broken-off stem of a fastener beyond a rear end of the hydraulic cylinder.

The hollow piston part preferably carries one or more seals around its periphery, to seal between the piston assembly and the hydraulic cylinder and thereby prevent hydraulic fluid from flowing between them. Advantageously, the hollow piston part may carry at least two such peripheral seals which are spaced apart from each other along part of the length of the elongate draw part. The, or each, seal preferably is formed from a polymeric material, e.g. a polyurethane. The hollow piston part may include an aperture extending therethrough between the hollow region of the hollow piston part and the periphery of the hollow piston part at a location between the two peripheral seals, the aperture communicating with a second aperture extending between a periphery of the elongate draw part and the hollow region thereof. The apertures may be provided in order to relieve/prevent air pressure build up between the peripheral seals. The hollow piston part may carry a bearing strip around its periphery, located between the two peripheral seals. The bearing strip (if present) may aid in centralization of the hydraulic piston assembly in the cylinder and/or may prevent (or reduce) metal to metal contact, for example.

A spring and/or other resiliently compressible means in the fastener installation tool may contact a rear surface of the hollow piston part and/or the stop portion of the elongate draw part, in order to return the hydraulic piston assembly to its forward or starting position once the stem of a fastener has been drawn back (and optionally removed) and the hydraulic pressure in front of the piston part has been relieved.

The fastener installation tool according to the invention preferably is a hydraulic-pneumatic tool, for example of the type disclosed in U.S. Pat. No. 4,517,820, GB 2116102 A and EP 0828575 B1.

The fastener installation tool according to the invention may, for example, be a hand-held tool or a tool (e.g. a tool module) configured to be operated by a robot or other automated fastener installation apparatus.

Preferably the invention provides an automated fastener installation apparatus, or a robotic fastener installation apparatus, including a fastener installation tool as set out herein.

BRIEF DESCRIPTION OF THE DRAWINGS

Preferred embodiments of the invention will now be described, by way of example, with reference to the accompanying drawings, of which.

DETAILED DESCRIPTION OF THE INVENTION

Figure 1:
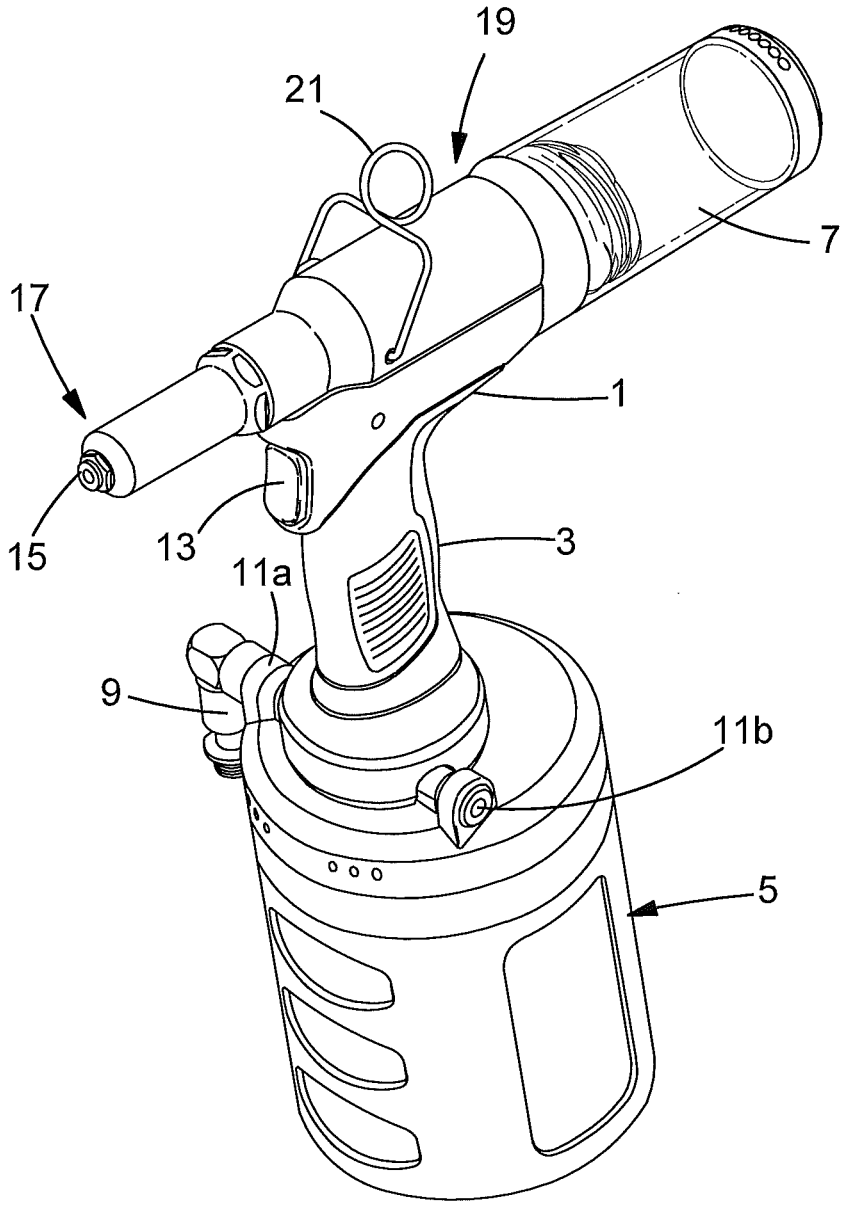
FIG. 1 is a perspective view of an embodiment of a fastener installation tool according to the invention.

FIG. 1 shows an embodiment of a hand-held fastener installation tool according to the invention, comprising a breakstem rivet installation tool. The fastener installation tool comprises a main body 1 which includes a handle 3, and the tool also includes a pneumatic cylinder and piston arrangement 5 and a fastener stem collection container 7. The tool is pneumatically powered by compressed air which is supplied to the tool, in use, via an air supply hose (not shown) which may be attached to an air supply connector 9. The air supply connector 9 may be attached to either of two air supply openings 11*a* and 11*b* located, respectively, on the right and left sides of the main body 1 of the tool, below the handle 3. The tool is actuated, in use, by means of a trigger valve 13 located at the top of the handle 3. A fastener support part 15 (commonly referred to as an anvil) is located at a front end 17 of the main body 1, and the fastener stem collection container 7 is located at an opposite rear end 19 of the main body. A suspension ring part 21, by which the tool may be suspended from a line in use, is attached to the main body 1 between the front and rear ends.

Figure 2:
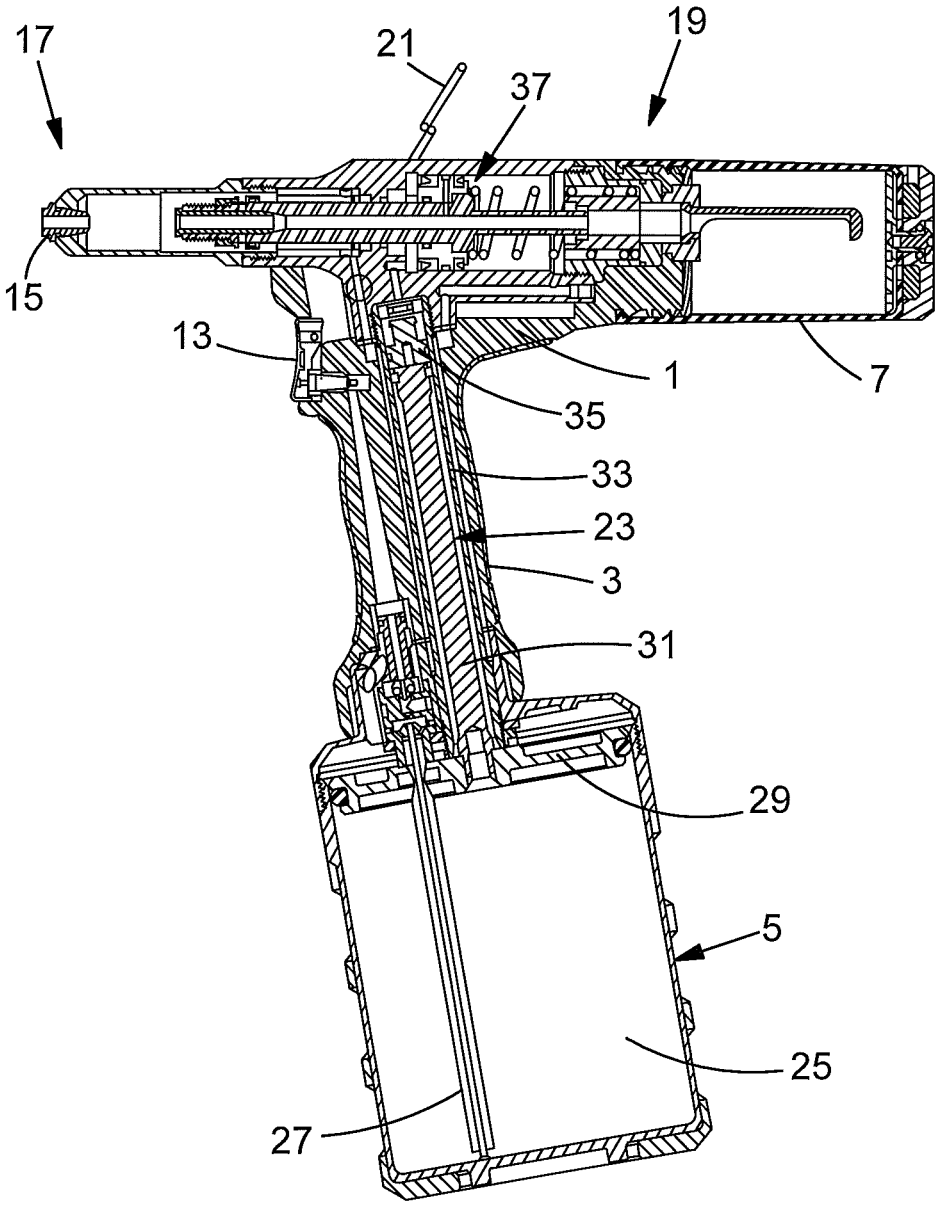
FIG. 2 is a cross-sectional view of the fastener installation tool shown in FIG. 1.

FIG. 2 shows, in cross-section, the hand-held fastener installation tool of FIG. 1. The pneumatic cylinder and piston arrangement 5, and a hydraulic master cylinder and piston arrangement 23, both of which are known, are shown. In use, actuation of the trigger valve 13 by the user causes air from the air supply hose to enter the pneumatic cylinder 25 via a tube 27 and to force the pneumatic piston 29 upwards towards the handle 3. Attached to, and extending from, the pneumatic piston 29, is an elongate hydraulic master piston 31 and, ahead of it in the hydraulic master cylinder 33, a separate hydraulic master piston member 35. As shown in FIG. 2, the pneumatic piston 29, the hydraulic master piston 31 and the hydraulic master piston member 35 have all been forced upwardly in the direction of the main body 1 of the tool. However, for clarity, FIG. 2 does not include hydraulic fluid in the hydraulic master cylinder 33, and consequently the (slave) hydraulic piston assembly 37 (described below) is not shown in its rearwards position. The skilled person will understand that, in practice, with the hydraulic fluid present, the slave hydraulic piston assembly 37 would have been forced backwards with the pneumatic and master hydraulic pistons in their illustrated positions. The illustrated known arrangement of pneumatic cylinder and piston, and hydraulic master cylinder and piston, constitute a so-called pneumatic-hydraulic intensifier.

Figure 3:
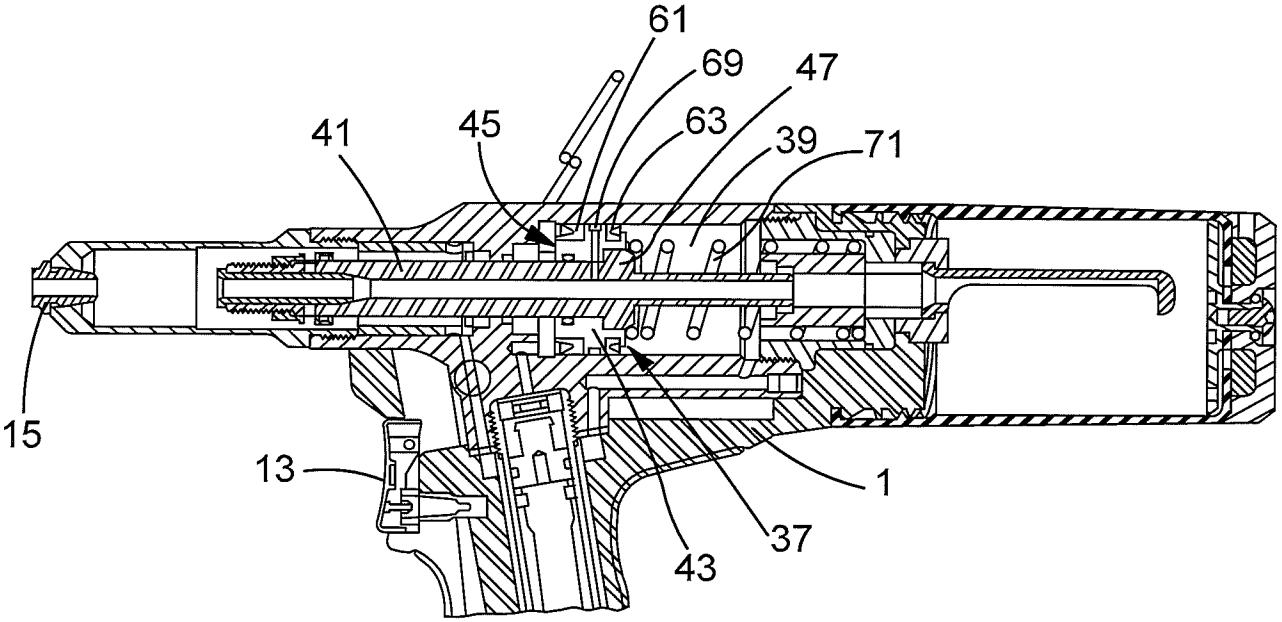
FIG. 3 shows a detail from FIG. 2, in particular the portion of the main body of the installation tool situated above the handle.
Figure 4A:
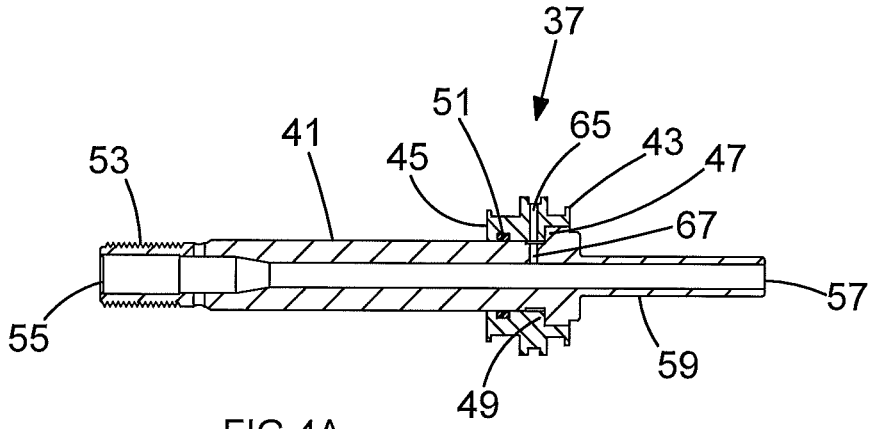
FIG. 4*a* is a cross-sectional view.
Figure 4B:
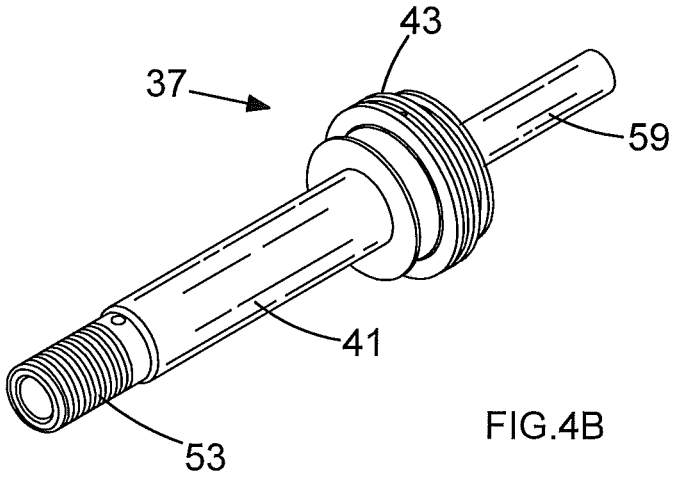
FIG. 4*b* is a perspective view, of the main parts of the hydraulic piston assembly of the fastener installation tool shown in FIGS. 1 to 3.

With reference to FIGS. 3, 4*a* and 4*b*, an upper portion of the main body 1 of the fastener installation tool situated above the handle 3 includes a (slave) hydraulic cylinder 39 and the (slave) hydraulic piston assembly 37 located in the hydraulic cylinder 39 for use in drawing back the stem of a fastener (not shown). The hydraulic piston assembly 37 comprises an elongate draw part 41 and a separate hollow piston part 43 mounted on the elongate draw part such that the elongate draw part extends through the hollow piston part. In use, when the trigger valve 13 is actuated and hydraulic fluid is forced out of the master hydraulic cylinder 33, the hydraulic fluid enters the (slave) hydraulic cylinder 39 in front of the hollow piston part 43 of the piston assembly 37, thereby forcing the piston assembly 37 rearwards within the cylinder 39. This causes a fastener stem gripping assembly (not shown), directly or indirectly attached to the front of the elongate draw part 41, to draw back and remove the stem of a fastener (not shown) being installed.

The hollow piston part 43 provides most of the hydraulic fluid contacting piston surface 45 of the hydraulic piston assembly 37, and together with the peripheral seal 61 provides the entire hydraulic fluid contacting piston surface. The elongate draw part 41 of the hydraulic piston assembly 37 includes a stop portion 47 against which a stop region 49 of the hollow piston part 43 abuts. The stop portion 47 of the elongate draw part 41 comprises a laterally outwards projecting portion. In use, the hydraulic fluid in the hydraulic cylinder 39 is situated on an opposite side of the hollow piston part 43 to the stop portion 47 of the elongate draw part 41. Part of the hollow piston part 43 extends around most of the stop portion 47 of the elongate draw part 41. In the illustrated embodiments, the hollow piston part 43 of the hydraulic piston assembly 37 is press-fitted on the elongate draw part 41. An O-ring seal 51 is located between the elongate draw part 41 and the hollow piston part 43.

A screw threaded front region 53 of the elongate draw part 41 of the hydraulic piston assembly 37 is arranged to have a fastener stem gripping assembly (not shown) attached directly or indirectly thereto. The elongate draw part 41 is hollow along its length, to permit, in use, a broken-off stem of a fastener to travel therethrough from its front end 55 to its rear end 57 and to be expelled therefrom into the fastener stem collection container 7 attached to the fastener installation tool. A rear region 59 of the elongate draw part 41 comprises a hollow guidance portion for guiding, in use, a broken-off stem of a fastener beyond a rear end of the hydraulic cylinder 39.

The hollow piston part 43 carries two spaced apart seals 61 and 63 around its periphery, to seal between the hydraulic piston assembly 37 and the hydraulic cylinder 39 and thereby prevent hydraulic fluid from flowing between them. The hollow piston part 43 also includes an aperture 65 extending therethrough between the hollow region of the hollow piston part and the periphery of the hollow piston part at a location between the two peripheral seals, the aperture communicating with a second aperture 67 extending between a periphery of the elongate draw part 41 and the hollow region thereof. The apertures 65 and 67 are provided in order to relieve/prevent air pressure build up between the peripheral seals 61 and 63. The hollow piston part also carries a bearing strip 69 around its periphery, located between the two peripheral seals 61 and 63. The bearing strip 69 aids in centralization of the hydraulic piston assembly 37 in the cylinder 39 and may prevent (or reduce) metal to metal contact between the piston and the cylinder.

A helical spring 71 contacts a rear surface of the hollow piston part 43 and the stop portion 47 of the elongate draw part 41, in order (and in conjunction with compressed air in the same region of the cylinder 39) to return the hydraulic piston assembly 37 to its forward or starting position once the stem of a fastener has been drawn back and removed, and the hydraulic pressure in front of the piston part has been relieved by the user releasing the trigger valve 13.

Figure 5A:
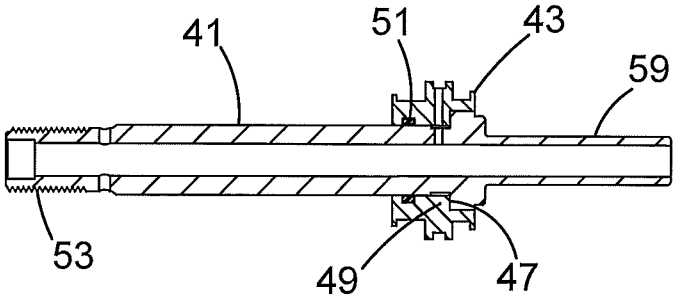
FIG. 5*a* is a cross-sectional view.
Figure 5B:
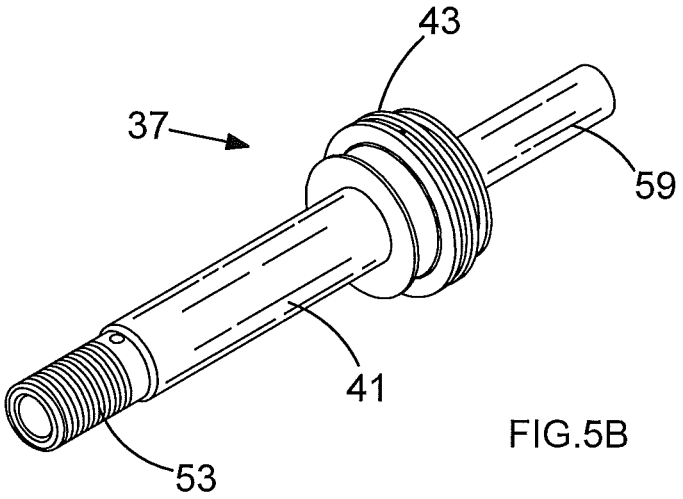
FIG. 5*b* is a perspective view, of the main parts of a hydraulic piston assembly of another embodiment of a fastener installation tool according to the invention.

FIGS. 5*a* and 5*b* show a similar hydraulic piston assembly 37 to that shown in FIGS. 2, 3, 4*a* and 4*b*, and the same reference numerals are used to indicate the same or similar parts thereof. In FIGS. 4*a* and 4*b*, and also in FIGS. 5*a* and 5*b*, the seals 61 and 63, and the bearing strip 69, are omitted.

As explained above, the elongate draw part 41 and the hollow piston part 43 of the hydraulic piston assembly 37 of both illustrated embodiments are formed from different materials. In particular, the material of the hollow piston part 43 has a lower density, a lower strength and a lower toughness than does the material of the elongate draw part 41. In the illustrated embodiments of the invention, the hollow piston part 43 is formed from a low density metal material in the form of an aluminium alloy. The elongate draw part 41 is formed from a high strength steel.

As also explained above, forming the elongate draw part 41 and the hollow piston part 43 of the hydraulic piston assembly 37 from such different materials provides the advantage that each part is optimized separately, resulting in significant benefits both for the manufacturer and for the end user. Thus, the amount of high density, high strength, high toughness material (high strength steel) which is used is minimized, and thus also the amount of machining of such a material is minimized (plus the time, effort and cost involved). Additionally, the weight, cost, and machining difficulty associated with the hollow piston part of the hydraulic piston assembly is minimized. Furthermore, the user of the fastener installation tool is provided with a lighter weight tool, which may also be more durable because the materials and the functional characteristics of each of the elongate draw part 41 and the hollow piston part 43 have been optimized separately. A lighter weight tool makes the tool easier to use, and may provide greater durability.

It will be understood that the above description and the drawings are of particular example embodiments of the invention, but other embodiments of the invention are included in the scope of the claims.

The invention claimed is:

1. A fastener installation tool for installing a fastener by gripping and drawing back a stem of the fastener, comprising a hydraulic cylinder, and a hydraulic piston assembly located in the hydraulic cylinder for use in drawing back the stem of a fastener, the hydraulic piston assembly characterised by comprising an elongate draw part of first tensile strength and a separate hollow piston part of second tensile strength, which hollow piston part is mounted on the elongate draw part such that the elongate draw part extends at least partly therethrough, wherein the elongate draw part and the hollow piston part are formed from different materials and wherein the hollow piston part provides substantially the entire hydraulic fluid contacting piston surface of the hydraulic piston assembly.

2. The fastener installation tool of claim 1, wherein the first tensile strength is lower than the second tensile strength.

3. The fastener installation tool of claim 1, wherein the material of the hollow piston part has a lower density than does the material of the elongate draw part and the hollow piston part is formed from aluminium, or an aluminium alloy.

4. The fastener installation tool of claim 1, wherein the material of the hollow piston part has a lower toughness than does the material of the elongate draw part, wherein the elongate draw part is formed from steel or a high strength steel.

5. The fastener installation tool of claim 1, wherein the elongate draw part includes a stop portion against which a stop region of the hollow piston part abuts, the stop portion of the elongate draw part comprising a laterally outwards projecting portion.

6. The fastener installation tool of claim 5, wherein in use, any hydraulic fluid in the hydraulic cylinder is situated on an opposite side of the hollow piston part to the stop portion of the elongate draw part.

7. The fastener installation tool of claim 5, wherein at least part of the hollow piston part extends around at least part of the stop portion of the elongate draw part, and the hollow piston part is fixed in place on the elongate draw part.

8. The fastener installation tool of claim 7, wherein the hollow piston part is press-fitted on the elongate draw part.

9. The fastener installation tool of claim 1, wherein the elongate draw part is hollow along its length, to permit, in use, a broken-off stem of a fastener to travel therethrough from a front end to a rear end of the elongate draw part and to be expelled therefrom.

10. The fastener installation tool of claim 1, wherein the elongate draw part and the hollow piston part are sealed together to prevent hydraulic fluid from flowing between them.

11. The fastener installation tool of claim 1, further comprising at least one seal located between the elongate draw part and the hollow piston part, to prevent hydraulic fluid from flowing between them, and wherein the hollow piston part carries one or more seals around its periphery, to seal between the piston assembly and the hydraulic cylinder and thereby prevent hydraulic fluid from flowing between them.

12. The fastener installation tool of claim 11, wherein the hollow piston part carries at least two such peripheral seals which are spaced apart from each other along part of the length of the elongate draw part.

13. A fastener installation tool according to claim 12, wherein the elongate draw part and the hollow piston part are sealed together to prevent hydraulic fluid from flowing between them, and wherein the hollow piston part includes an aperture extending therethrough between the hollow region of the hollow piston part and the periphery of the hollow piston part at a location between the two peripheral seals, the aperture communicating with a second aperture extending between a periphery of the elongate draw part and the hollow region thereof.

14. The fastener installation tool of claim 12, wherein the hollow piston part carries a bearing strip around its periphery, located between the two peripheral seals.

15. The fastener installation tool of claim 1, wherein the elongate draw part extends entirely through the hollow piston part.

16. The fastener installation tool of claim 1, wherein a rear region of the elongate draw part includes a hollow guidance portion which is attached to, or formed in one piece with, the remainder of the elongate draw part, for at least assisting in the guidance, in use, of a broken-off stem of a fastener beyond a rear end of the hydraulic cylinder.

17. The fastener installation tool of claim 1, wherein a spring and/or other resiliently compressible means contacts a rear surface of the hollow piston part and/or the stop portion of the elongate draw part.

* * * * *